US006364124B1

(12) United States Patent
Chen

(10) Patent No.: US 6,364,124 B1
(45) Date of Patent: Apr. 2, 2002

(54) BURGLARPROOF LOCKING DISPLAY STAND

(75) Inventor: Feng-Ming Chen, Chung Ho (TW)

(73) Assignee: Chenbro Micom Co., Ltd., Taipei (TW)

( * ) Notice: Subject to any disclaimer, the term of this patent is extended or adjusted under 35 U.S.C. 154(b) by 0 days.

(21) Appl. No.: 09/764,394

(22) Filed: Jan. 19, 2001

(30) Foreign Application Priority Data

Dec. 29, 2000 (TW) ..... 89222744

(51) Int. Cl.[7] ..... A47F 7/02
(52) U.S. Cl. ..... 211/4; 211/85.1
(58) Field of Search ..... 211/4, 85.1

(56) References Cited

U.S. PATENT DOCUMENTS 3,326,385 A * 6/1967 Pinkerton et al. ..... 211/4
4,805,781 A 2/1989 Tegel ..... 211/13.1
6,182,840 B1 * 2/2001 Tegel ..... 211/85.1

* cited by examiner

*Primary Examiner*—Daniel P. Stodola
*Assistant Examiner*—Erica B. Harris
(74) *Attorney, Agent, or Firm*—Rosenberg, Klein & Lee

(57) ABSTRACT

Burglarproof locking display stand includes a display panel. A rack protrudes from and is firmly fixed on outer face of the display panel. A lock seat is fixedly mounted on inner face of the display panel. A lock hook has an inner end that is be pivotally connected with the lock seat. An outer end of the lock hook extends out from the outer face of the display panel, the lock hook being deflectable and rotatable to close and mate the outer end with the outer end of the rack so as to lock a displayed article bridged over the rack. A lock latch transversely rides on a slide channel of the lock seat. A solenoid-controlled valve is fixedly mounted on the lock seat, to control the abutment of the lock latch against the lock hook in a first locked position or to a second unlocked position.

9 Claims, 5 Drawing Sheets

BURGLARPROOF LOCKING DISPLAY STAND

BACKGROUND OF THE INVENTION

1. Field of the Invention

The present invention is related to a burglarproof locking display stand, and more particularly to a burglarproof locking display stand including a solenoid-controlled valve for operatively controlling a lock hook to one by one lock the displayed articles rested on the display panel. Therefore, the displayed articles are protected from being stolen or burglarized.

2. Description of the Prior Art

A conventional stand for displaying spectacles, purses, decorations, etc. generally includes a fixed seat and a rack body on which the displayed articles are hung. Such stand lacks any locking device for locking these displayed articles. Therefore, the articles tend to be stolen or burglarized.

U.S. Pat. No. 4,805,781 discloses a displaying stand with locking function. The stand includes a fixed frame part having multiple protruding elements on which the displayed articles are hung. A movable part is slidably mounted on inner side of the fixed frame part. Multiple protruding locking hooks are arranged on the movable part respectively corresponding to the protruding elements. The protruding elements can cooperate with the locking hooks to form a number of eye configurations, each encompassing and locking the displayed article. The locking hooks are integrally connected with the movable part and vertically displaceable along with the movable part. Accordingly, all the displayed articles are at the same time locked or unlocked, but it is impossible to lock or unlock the displayed articles one by one. That is, when a consumer desires to take out a specific article, the seller must unlock all the displayed articles for taking out the specific article. This gives a great chance to a thief or a burglar to steal or rob the displayed articles. Therefore, such displaying stand can hardly provide a security effect. In addition, a motor is operated to drive a crank plate which drives the movable part to move upward for unlocking. A great power is consumed during operation and a great noise is produced due to frictional resistance. Moreover, such mechanism is liable to fail.

SUMMARY OF THE INVENTION

It is therefore a primary object of the present invention to provide a burglarproof locking display stand including: a display panel; a rack protruding from and firmly fixed on outer face of the display panel; a lock seat fixedly mounted on inner face of the display panel; a lock hook, an inner end of the lock hook being pivotally connected with the lock seat, an outer end of the lock hook extending out from the outer face of the display panel, the lock hook being deflectable and rotatable to close and mate the outer end with the outer end of the rack so as to lock a displayed article bridged over the rack; a lock latch transversely riding on a slide channel of the lock seat; and a solenoid-controlled valve fixedly mounted on the lock seat. In normal state, the solenoid-controlled valve drivingly makes the lock latch abut against a bottom edge of the inner end of the lock hook, whereby the outer end of the lock hook is prevented from being freely pivotally lifted and kept in a locked state. When energized, the solenoid-controlled valve operatively transversely moves the lock latch to aim a notch thereof at the bottom edge of the inner end of the lock hook, whereby the lock hook can be freely, pivotally, and upwardly rotated to open the outer end of the lock hook from the rack, permitting the displayed article to be taken out from the rack.

The present invention can be best understood through the following description and accompanying drawings wherein:

DETAILED DESCRIPTION OF THE PREFERRED EMBODIMENTS

Figure 1:
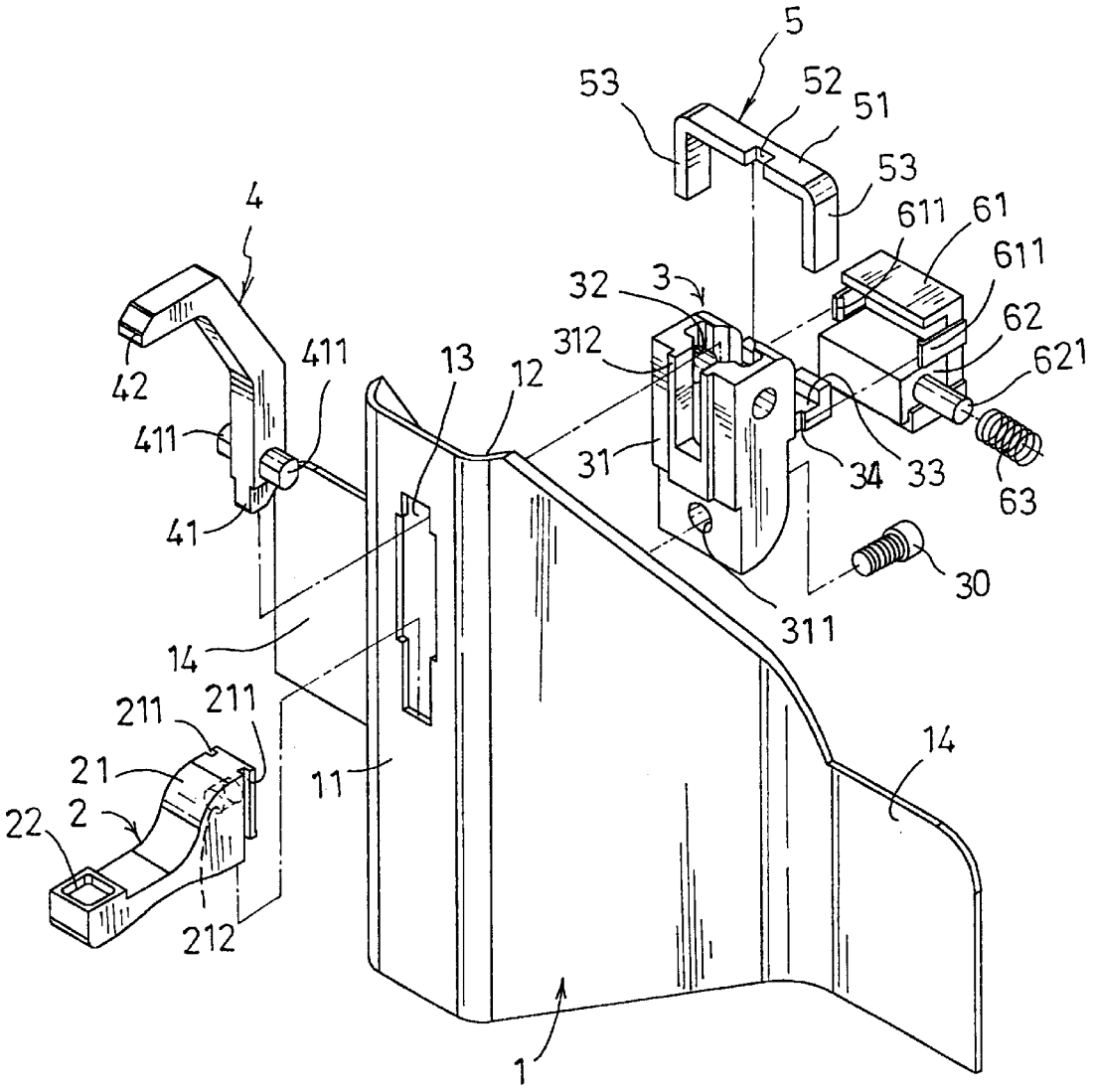
FIG. 1 is a perspective exploded view of the present invention.

Please refer to FIGS. 1 to 6. The burglarproof locking display stand of the present invention includes: a display panel 1; a rack 2 protruding from and firmly fixed on outer face 11 of the display panel 1; a lock seat 3 fixedly mounted on inner face 12 of the display panel 1; a lock hook 4, an inner end of the lock hook 4 being pivotally connected with the lock seat 3, an outer end 42 of the lock hook 4 extending out from the outer face 11 of the display panel 1, the lock hook 4 being deflectable and rotatable to close and mate the outer end 42 with the outer end of the rack 2 so as to lock a displayed article W bridged over the rack 2; a lock latch 5 transversely riding on the lock seat 3 and formed with a notch 52; and a solenoid-controlled valve 6 fixedly mounted on the lock seat 3. In normal state, the solenoid-controlled valve 6 drivingly makes the lock latch 5 abut against a bottom edge of the inner end 41 of the lock hook 4, whereby the outer end 42 of the lock hook 4 is prevented from being freely pivotally lifted and kept in a locked state. The solenoid-controlled valve 6 can operatively, transversely move the lock latch 5 to aim the notch 52 thereof at the bottom edge of the inner end 41 of the lock hook 4. Under such circumstance, the lock hook 4 can be freely pivotally upward rotated into an unlocked state. At this time, the outer end 42 of the lock hook 4 is no more closed and mated with the rack 2, permitting the displayed article W to be taken out from the rack 2.

Figure 2:
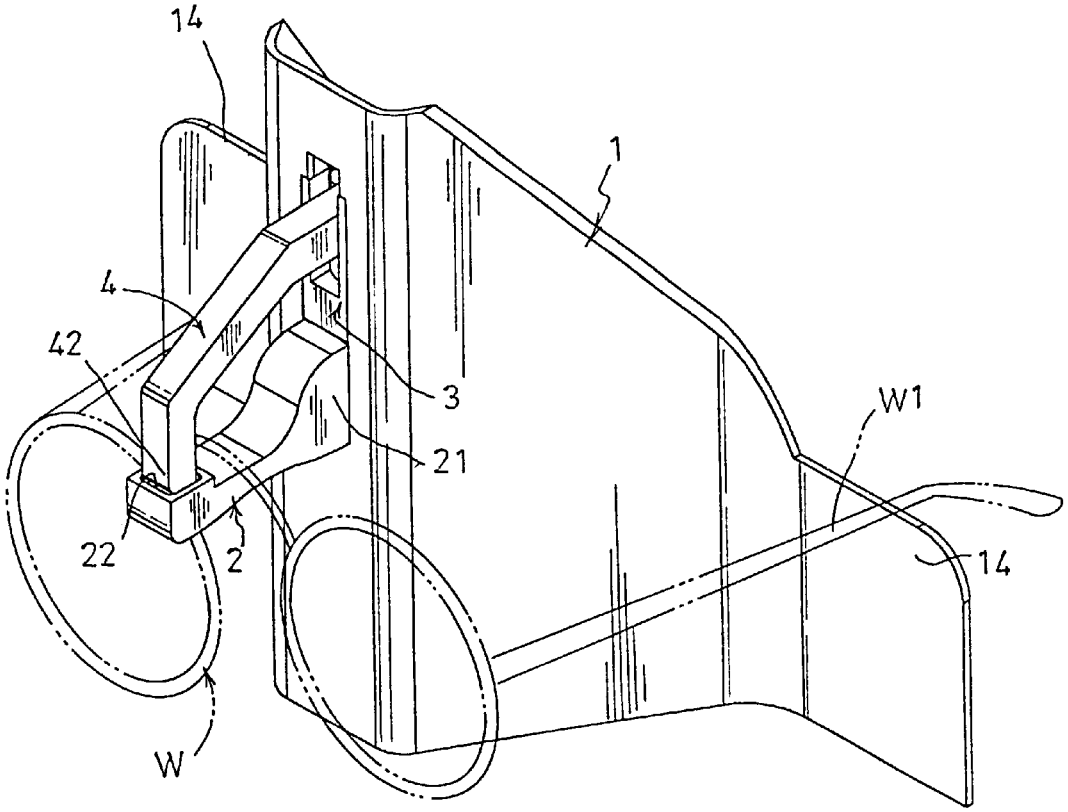
FIG. 2 is a perspective assembled view of the present invention.

Referring to FIGS. 1 and 2, the display panel 1 is at least formed with a fixing slot 13 in which the rack 2 is inserted and mounted. The lock hook 4 extends through the fixing slot 13 from the inner side of the display panel 1 to the outer side thereof. At least one wing section 14 is formed on each lateral side of the display panel 1. The temples W1 of a pair of displayed spectacles W can be rested on the wing sections 14.

The rack 2 is made of metal material. The inner end of the rack 2 is formed as a seat section 21 having two latching channels 211 on two lateral sides. Two lateral edges of the fixing slot 13 of the display panel 1 are slidably fitted in the latching channels 211, whereby the rack 2 radially, fixedly protrudes from the outer face 11 of the display panel 1. The outer end of the rack 2 is formed with a dent 22. The outer end 42 of the lock hook 4 can extend into the dent 22.

The lock seat 3 includes: a seat body 31 formed with at least one fixing hole 311, a tightening screw 30 being passed through the fixing hole 311 to tighten the seat body 31 on inner side of the display panel 1, a pivot cavity 32 being formed on a top end of the seat body 31 and extending downward for pivotally mounting the inner end 41 of the lock hook 4 therein; and a slide channel 33 transversely disposed on rear side of the seat body 31. The lock latch 5 is transversely slidably fitted in the slide channel 33.

The front face of the seat body 31 of the lock seat 3 is formed with a locating lip 312 snugly inserted in the fixing slot 13 of the display panel 1. The fixing hole 311 is aligned with a fixing thread hole 212 of the rack 2. The tightening screw 30 is passed through the fixing hole 311 and screwed into the fixing thread hole 212 of the rack 2 so as to fixedly connect the seat body 31 with the rack 2 and tightly clamp the display panel 1 between the rack 2 and the seat body 31.

As shown in FIG. 1, two pivot shafts 411 respectively project from two sides of the inner end 41 of the lock hook 4 for pivotally mounting in the pivot cavity 32 of the lock seat 3. The outer end 42 of the lock hook 4 extends through the fixing slot 13 of the display panel 1 to the outer side thereof. In normal state, the outer end 42 is fitted in the dent 22 of the rack 2 to form an eye configuration for encompassing and locking the displayed article W hung on the rack 2.

The lock latch 5 includes a bar section 51 riding over the slide channel. 33 of the lock seat 3. A front edge of the bar section 51 is formed with a notch 52 dimensioned to permit the inner end 41 of the lock hook 4 to freely vertically pass therethrough. Two side wall sections 53 respectively, downwardly extend from two sides of the bar section 51. A valve rod 621 of the solenoid-controlled valve 6 is positioned between the two side wall sections 53.

The solenoid-controlled valve 6 includes: a fixing case 61, at least one latching arm 611 extending from each lateral side of the fixing case 61, which latching arm is correspondingly latched in the latching channels 34 formed on two sides of the lock seat 3, whereby the fixing case 61 is firmly mounted on the rear side of the lock seat 3; a solenoid-controlled valve body 62 snugly inserted in the fixing case 61, a valve rod 621 being transversely slidably fitted in the solenoid-controlled valve body 62, the valve rod 621 being positioned between the two side wall sections 53 of the lock latch 5 with two ends of the valve rod 621 leant against the side wall sections 53; and a restoring spring 63. In normal state, the restoring spring 63 is compressed between one side wall section 53 of the lock latch 5 and the solenoid-controlled valve body 62 for pushing the lock latch 5 to make the notch 52 thereof deflect from the moving path of the inner end 41 of the lock hook 4. Under such circumstance, the bar section 51 of the lock latch 5 is leant against the lower edge of the inner end 41 of the lock hook 4 to prevent the lock hook 4 from freely moving. Therefore, it is ensured that the outer end 42 of the lock hook 4 and the rack 2 encompass and lock the displayed article. After the solenoid-controlled valve body 62 is energized, the valve rod 621 is transversely driven and slide, whereby the lock latch 5 is moved to align the notch 52 with the moving path of the inner end 41 of the lock hook 4. Under such circumstance, the lock hook 4 can be freely pivotally deflected to unlock the lock hook 4 from the rack 2 and permit the displayed article W to be taken out from the rack 2.

Figure 3:
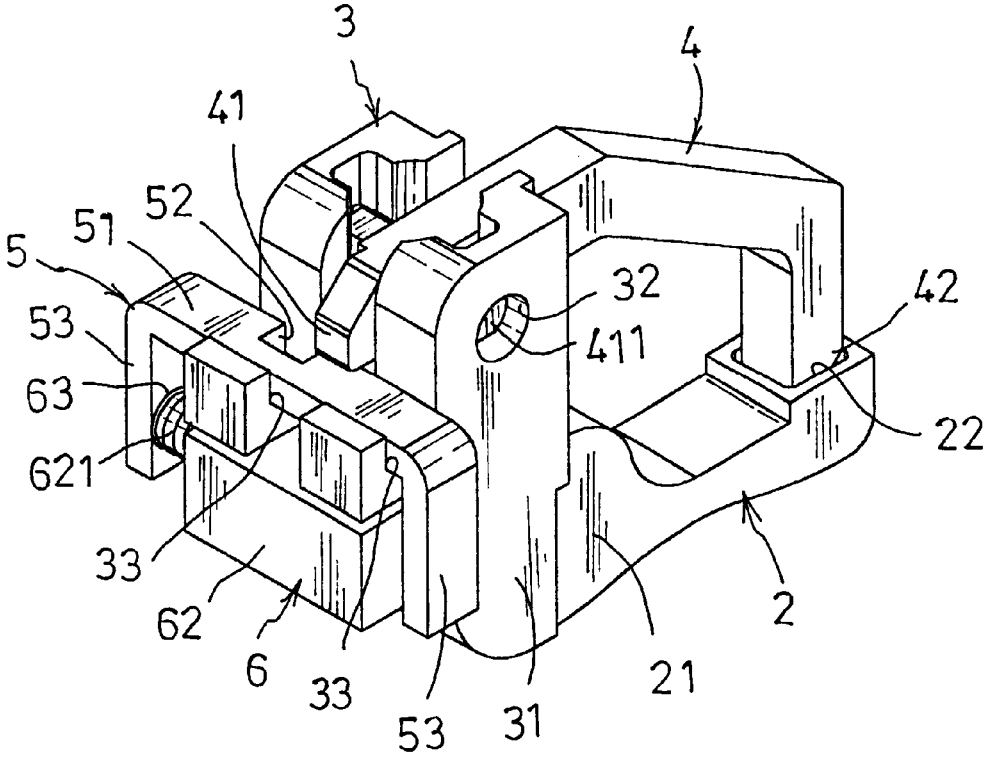
FIG. 3 is a perspective assembled view of the present invention in a locked state.
Figure 4:
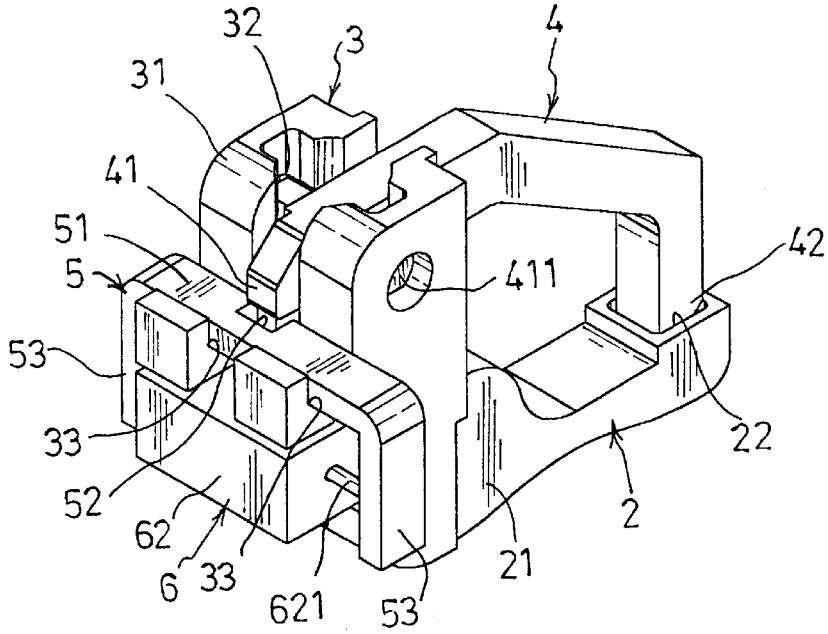
FIG. 4 is a view according to FIG. 3, in which the lock latch is driven and moved for unlocking.
Figure 5:
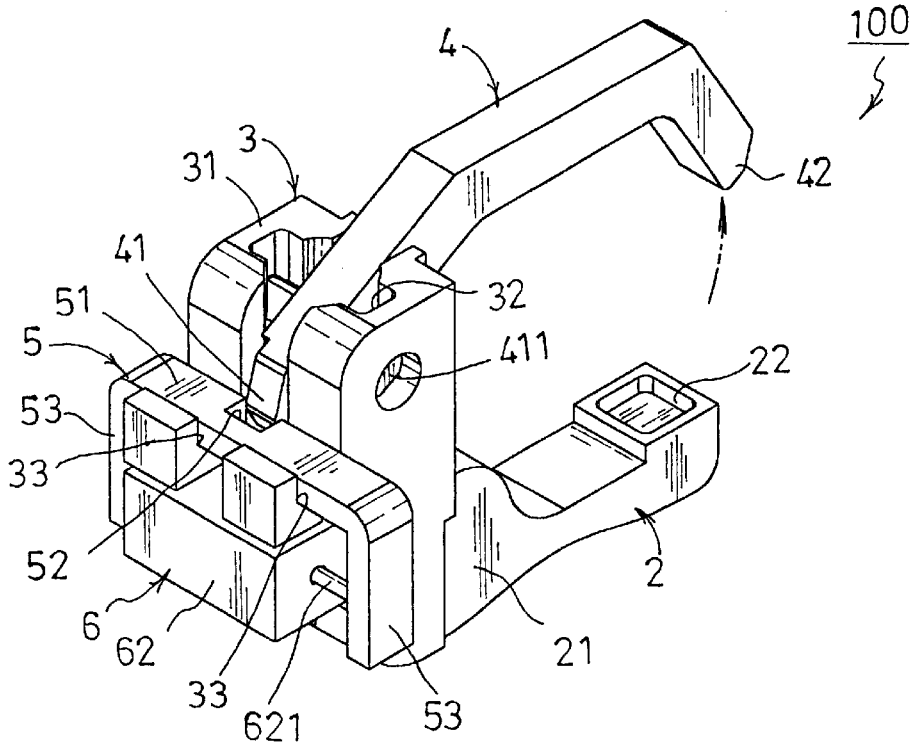
FIG. 5 is a view according to FIG. 4, in which the lock hook is upward pivotally rotated and opened from the rack.

Referring to FIGS. 2 and 3, in normal state, the displayed article W hung on the rack 2 is encompassed and locked by an eye configuration formed by the rack 2 and the lock hook 4 and cannot be taken out. Therefore, the displayed article W is protected from being stolen or burglarized. When a consumer desires to hold the displayed article W, the seller can energize the solenoid-controlled valve 6 to align the notch 52 of the lock latch 5 with the moving path of the inner end 41 of the lock hook 4 as shown in FIG. 4. Then, as shown in FIG. 5, the lock hook 4 can be pivotally rotated upward to disengage the outer end 42 of the lock hook 4 from the outer end of the rack 2. At this time, the consumer can take out the displayed article W from the rack 2.

The displayed article hung on the rack 2 can be a pair of spectacles, accessories of mobile phone, key ring, purse, etc.

Figure 6:
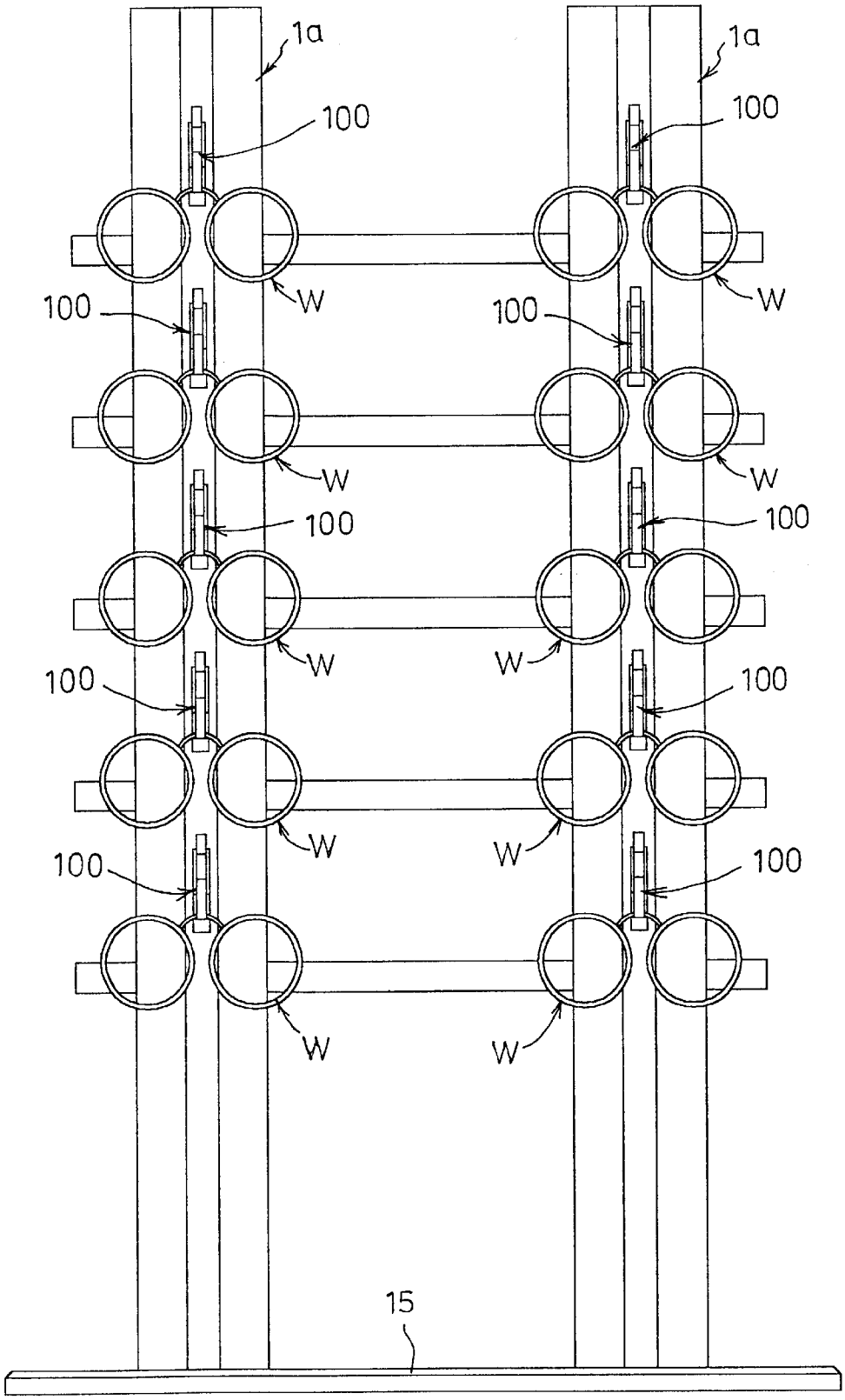
FIG. 6 shows the application of the burglarproof locking display stand of the present invention.

Referring to FIGS. 5 and 6, the burglarproof locking display stand of the present invention can further include at least one fixing tray 15. At least one vertical display panel la is fixed on the fixing tray 15. Several sets of lock bodies 100 can be fixedly mounted on the display panel la as a row. Each lock body 100 is composed of a rack 2, a lock seat 3, a lock hook 4, a lock latch 5 and a solenoid-controlled valve 6. Accordingly, a number of displayed articles W can be hung on the vertical display panel la at the same time and locked one by one. A number of vertical display panels 1*a* can be freely arranged into a matrix or an arch as required by the display site.

In the burglarproof locking display stand of the present invention, each lock hook 4 is controlled by a solenoid-controlled valve 6. Therefore, one single displayed article W can be solely unlocked and taken out as necessary, while other displayed articles W remain locked. Therefore, the displayed articles W rested on the display stand are protected from being stolen or burglarized.

The above embodiments are only used to illustrate the present invention, not intended to limit the scope thereof. Many modifications of the above embodiments can be made without departing from the spirit of the present invention.

What is claimed is:

1. Burglarproof locking display stand comprising:

a display panel;

a rack protruding from and firmly fixed on an outer face of the display panel;

a lock seat fixedly mounted on an inner face of the display panel;

a lock hook, an inner end of the lock hook being pivotally connected with the lock seat, an outer end of the lock hook extending out from the outer face of the display panel, the lock hook being deflectable and rotatable to close and mate the outer end with the outer end of the rack so as to lock a displayed article bridged over the rack;

a lock latch transversely riding on a slide channel of the lock seat; and a solenoid-controlled valve fixedly mounted on the lock seat, in normal state, the solenoid-controlled valve drivingly making the lock latch abut against a bottom edge of the inner end of the lock hook, whereby the outer end of the lock hook is prevented from being freely, pivotally lifted and kept in a locked state, when the solenoid-controlled valve is energized, the solenoid-controlled valve operatively, transversely moves the lock latch to aim a notch thereof at the bottom edge of the inner end of the lock hook, whereby the lock hook can be freely, pivotally, upwardly rotated to open the outer end of the lock hook from the rack, permitting the displayed article to be taken out from the rack.

2. Burglarproof locking display stand as claimed in claim 1, wherein the display panel is at least formed with a fixing slot in which the rack is inserted and mounted, the lock hook extends through the fixing slot from the inner side of the display panel to the outer side thereof, at least one wing section being formed on each lateral side of the display panel, whereby for example, the temples of a pair of displayed spectacles can be rested on the wing sections.

3. Burglarproof locking display stand as claimed in claim 1, wherein the rack is made of metal material, the inner end of the rack being formed as a seat section having two latching channels on two lateral sides, two lateral edges of the fixing slot of the display panel being slidably fitted in the latching channels, whereby the rack radially, fixedly protrudes from the outer face of the display panel, the outer end of the rack being formed with a dent for the outer end of the lock hook to extend into the dent.

4. Burglarproof locking display stand as claimed in claim 1, wherein the lock seat includes: a seat body formed with at least one fixing hole; a tightening screw is passed through the fixing hole to tighten the seat body on inner side of the display panel; a pivot cavity is formed on a top end of the seat body and extends downward for pivotally mounting the inner end of the lock hook therein; and a slide channel transversely disposed on rear side of the seat body, the lock latch being transversely slidably fitted in the slide channel.

5. Burglarproof locking display stand as claimed in claim 4, wherein a front face of the seat body of the lock seat is formed with a locating lip snugly inserted in the fixing slot of the display panel, the fixing hole being aligned with a fixing thread hole of the rack, whereby the tightening screw is passed through the fixing hole and screwed into the fixing thread hole of the rack so as to fixedly connect the seat body with the rack and tightly clamp the display panel between the rack and the seat body.

6. Burglarproof locking display stand as claimed in claim 1, wherein two pivot shafts respectively project from two sides of the inner end of the lock hook for pivotally mounting in the pivot cavity of the lock seat, the outer end of the lock hook extends through the fixing slot of the display panel to the outer side thereof, in normal state, the outer end being fitted in the dent of the rack to form an eye configuration for encompassing and locking the displayed article hung on the rack.

7. Burglarproof locking display stand as claimed in claim 1, wherein the lock latch includes a bar section riding over the slide channel of the lock seat, a front edge of the bar section being formed with a notch dimensioned to permit the inner end of the lock hook to freely, vertically pass therethrough, two side wall sections respectively extends from two sides of the bar section, a valve rod of the solenoid-controlled valve being positioned between the two side wall sections.

8. Burglarproof locking display stand as claimed in claim 1, wherein the solenoid-controlled valve includes: a fixing case; at least one latching arm extending from each lateral side of the fixing case, which latching arm is correspondingly latched in the latching channel formed on each side of the lock seat, whereby the fixing case is firmly mounted on the rear side of the lock seat; a solenoid-controlled valve body snugly inserted in the fixing case; a valve rod being transversely, slidably fitted in the solenoid-controlled valve body, the valve rod being positioned between the two side wall sections of the lock latch with two ends of the valve rod leant against the side wall sections; and a restoring spring, in normal state, is compressed between one side wall section of the lock latch and the solenoid-controlled valve body for pushing the lock latch to make the notch thereof deflect from the moving path of the inner end of the lock hook, whereby the bar section of the lock latch is leant against the lower edge of the inner end of the lock hook to prevent the lock hook from freely moving and ensure that the outer end of the lock hook and the rack encompass and lock the displayed article.

9. Burglarproof locking display stand as claimed in claim 1, further comprising at least one fixing tray; at least one vertical display panel being fixed on the fixing tray; several sets of lock bodies being fixedly mounted on the display panel in a row, each lock body being composed of a rack, a lock seat, a lock hook, a lock latch and a solenoid-controlled valve, whereby a number of displayed articles can be rested on the vertical display panel at the same time and locked one by one.

* * * * *